US010194687B2

(12) United States Patent
Branton et al.

(10) Patent No.: US 10,194,687 B2
(45) Date of Patent: Feb. 5, 2019

(54) SMOKE FILTRATION

(75) Inventors: Peter Branton, London (GB); Ferdi Schuth, Mulheim an der Ruhr (DE); Manfred Schwickardi, Mulheim an der Ruhr (DE); Julia Schwickardi, legal representative, Muelheim an der Ruhr (DE)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 13/395,410

(22) PCT Filed: Sep. 9, 2010

(86) PCT No.: PCT/GB2010/051504

§ 371 (c)(1),
(2), (4) Date: May 23, 2012

(87) PCT Pub. No.: WO2011/030151

PCT Pub. Date: Mar. 17, 2011

(65) Prior Publication Data

US 2012/0222690 A1 Sep. 6, 2012

(30) Foreign Application Priority Data

Sep. 10, 2009 (GB) ..... 0915814.8

(51) Int. Cl.
*A24D 3/06* (2006.01)
*A24D 3/16* (2006.01)

(52) U.S. Cl.
CPC ..... *A24D 3/163* (2013.01); *A24D 3/067* (2013.01)

(58) Field of Classification Search
None
See application file for complete search history.

(56) References Cited

U.S. PATENT DOCUMENTS 3,351,071 A 11/1967 Belford
3,662,765 A 5/1972 Clark
5,508,341 A 4/1996 Mayer et al.
5,744,510 A 4/1998 Pekala
5,908,896 A 6/1999 Mayer et al.
(Continued)

FOREIGN PATENT DOCUMENTS

DE 102006049179 A1 4/2008
GB 2260477 A 4/1993
(Continued)

OTHER PUBLICATIONS

Zhonghua Hu, M.P. Srinivasan, Mesoporous high-surface-area activated carbon, In Microporous and Mesoporous Materials, vol. 43, Issue 3, 2001, pp. 267-275, ISSN 1387-1811, https://doi.org/10.1016/S1387-1811(00)00355-3. (http://www.sciencedirect.com/science/article/pii/S1387181100003553).*
(Continued)

*Primary Examiner* — Michael J Felton
(74) *Attorney, Agent, or Firm* — Cantor Colburn LLP

(57) ABSTRACT

The invention relates to a smoking article comprising a carbonaceous dried gel (3), (such as a xerogel, aerogel or cryogel), a filter (2) for a smoking article comprising a carbonaceous dried gel and the use of a carbonaceous dried gel for the filtration of smoke.

13 Claims, 2 Drawing Sheets

(56) References Cited

U.S. PATENT DOCUMENTS

| | | | | |
|---|---|---|---|---|
| 6,865,068 | B1 * | 3/2005 | Murakami | C01B 31/10 264/105 |
| 2006/0201524 | A1 * | 9/2006 | Zhang | A24D 3/163 131/207 |
| 2007/0204870 | A1 | 9/2007 | Deevi et al. | |
| 2008/0142028 | A1 | 6/2008 | Fagg | |
| 2009/0038632 | A1 | 2/2009 | Cashmore | |
| 2009/0176079 | A1 * | 7/2009 | Cabrera-Perez | C04B 38/0022 428/219 |

FOREIGN PATENT DOCUMENTS

| | | | |
|---|---|---|---|
| GB | 2261152 | A | 5/1993 |
| JP | 09-202610 | | 8/1997 |
| JP | 2005-187320 | | 7/2005 |
| JP | 2008-535754 | | 10/2006 |
| JP | 2008048650 | A | 3/2008 |
| KR | 920007008 | B | 8/1992 |
| WO | 95/03358 | A1 | 2/1995 |
| WO | 02/12380 | A2 | 2/2002 |
| WO | 2006/103404 | | 10/2006 |
| WO | 2007/104908 | A1 | 9/2007 |
| WO | WO2007104908 | A1 * | 9/2007 A24D 3/04 |

OTHER PUBLICATIONS

Job, Nathalie, et al., "Carbon aerogels, cryogels and xerogels: Influence of the drying method on the textural properties of porous carbon . . . ," Carbon (2005) vol. 43, p. 2481.

Li, Wen-Cui et al., "Hard Templating Pathway to Create Mesporous Magnesium Oxide," *Chem. Mater*. 2004, 16, 5676-5681.

Mola, Michele et al., "The characterisation and evaluation of activated carbon in a cigarette filter," *Adsorption* (2008) 14:335-341.

International Search Report and Written Opinion, dated Jan. 19, 2011, for PCT International Application No. PCT/GB2010/051504, filed Sep. 9, 2010.

International Preliminary Report on Patentability, dated Dec. 15, 2011, for PCT International Application No. PCT/GB2010/0515047, filed Sep. 9, 2010.

Office Action, dated Sep. 11, 2012, for Japanese Patent Application No. 2012-525217, citing Japanese Application 2008-535754, 09-202610, and 2005-187320.

* cited by examiner

SMOKE FILTRATION

CLAIM FOR PRIORITY

This application is a National Stage Entry entitled to and hereby claims priority under 35 U.S.C. §§ 365 and 371 to corresponding PCT Application No. PCT/GB2010/051504, filed Sep. 9, 2010, which in turn claims priority to British Application Serial No. GB 0915814.8, filed Sep. 10, 2009. The entire contents of the aforementioned applications are herein expressly incorporated by reference.

FIELD OF THE INVENTION

The present invention relates to the novel use of a particular type of porous carbon material for smoke filtration in smoking articles.

BACKGROUND TO THE INVENTION

Filtration is used to reduce certain particulates and/or vapour phase constituents of tobacco smoke inhaled during smoking. It is important that this is achieved without removing significant levels of other components, such as organoleptic components, thereby degrading the quality or taste of the product.

Smoking article filters are often composed of cellulose acetate fibres, which mechanically filter aerosol particles. It is also known to incorporate porous carbon materials into the filters (dispersed amongst the cellulose acetate fibres, or in a cavity in the filter) to adsorb certain smoke constituents, typically by physisorption. Such porous carbon materials can be made from the carbonized form of many different organic materials, most commonly plant-based materials such as coconut shell. However, synthetic polymers have also been carbonized to produce porous carbons. In addition, fine carbon particles have been agglomerated with binders to produce porous carbons, in the manner described in U.S. Pat. No. 3,351,071.

The precise method used to manufacture porous carbon material has a strong influence on its properties. It is therefore possible to produce carbon particles having a wide range of shapes, sizes, size distributions, pore sizes, pore volumes, pore size distributions and surface areas, each of which influences their effectiveness as adsorbents. The attrition rate is also an important variable; low attrition rates are desirable to avoid the generation of dust during high speed filter manufacturing.

Generally, porous carbons having a high surface area and large total pore volume are desired in order to maximise adsorption. However, this must be balanced with a low attrition rate. The surface area and total pore volume of conventional materials such as coconut carbons are limited by their relative brittleness. In addition, the ability to incorporate a large proportion of meso- and macropores is hindered by the strength of the material. As explained in *Adsorption* (2008) 14: 335-341, conventional coconut carbon is essentially microporous, and increasing the carbon activation time results in an increase in the number of micropores and surface area but produces no real change in pore size or distribution. Thus, it is generally not possible to produce coconut carbon containing a significant number of meso- or macropores.

Another factor to take into consideration is the fact that the residence time for smoke in a typical 27 mm-long cigarette filter, during standard measurements of tar content, is of the order of milliseconds. Thus, porous carbon materials for smoke filtration must be optimised to be very efficient adsorbers on such a short timescale.

In view of the foregoing, there is still room for improvement in the art with regard to the use of porous carbon materials for smoke filtration.

SUMMARY OF THE INVENTION

Accordingly, in a first aspect of the invention there is provided a smoking article comprising a carbonaceous dried gel.

In a second aspect of the invention there is provided a filter for use in a smoking article, comprising a carbonaceous dried gel.

In a third aspect of the invention there is provided the use of a carbonaceous dried gel for the filtration of smoke.

BRIEF DESCRIPTION OF THE DRAWINGS

For a fuller understanding of the invention, embodiments of the invention will be described by way of illustrative example with reference to the accompanying drawings in which.

DETAILED DESCRIPTION OF THE INVENTION

Figure 1:
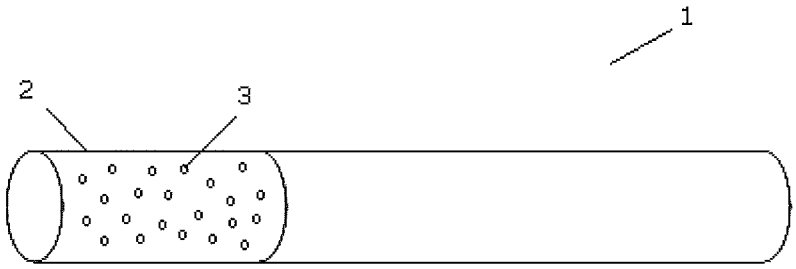
FIG. 1 shows carbonaceous dried gel particles distributed throughout a cigarette filter.

The present invention makes use of a carbonaceous dried gel. Such dried gels are porous, solid-state materials obtained from gels or sol-gels whose liquid component has been removed and replaced with a gas, which have then been pyrolyzed/carbonized. They can be classified according to the manner of drying and include carbon xerogels, aerogels and cryogels. Such types of materials per se are known.

Xerogels are typically formed using an evaporative drying stage under ambient pressure conditions. They generally have a monolithic internal structure, resembling a rigid, low density foam having e.g. 60-90% air by volume. Aerogels, on the other hand, can be produced using other methods such as supercritical drying. They contract less than xerogels during the drying stage and so tend to have an even lower density (e.g. 90-99% air by volume). Cryogels are produced using freeze drying.

Preferably, the dried gel of the invention is a carbon xerogel or carbon aerogel, preferably a carbon xerogel.

The dried gels used in the invention may be obtained from any source. Several different methods are available to make the gel to be dried. In an embodiment, the gel is obtained by the aqueous polycondensation of an aromatic alcohol (preferably resorcinol) with an aldehyde (preferably formaldehyde). In an embodiment, the catalyst is sodium carbonate. An illustrative method is described in *Chem. Mater.* (2004) 16, 5676-5681.

The dried carbonaceous gels used in the invention may be obtained by a first step of producing a polycondensate by polycondensation of an aldehyde and an aromatic alcohol. If available, a commercially available polycondensate may be used.

To produce the polycondensate, the starting material may be an aromatic alcohol such as phenol, resorcinol, catechin, hydrochinon and phloroglucinol, and an aldehyde such as formaldehyde, glyoxal, glutaraldehyde or furfural. A commonly used and preferred reaction mixture comprises resorcinol (1,3-dihydroxybenzol) and formaldehyde, which react with one another under alkaline conditions to form a gel-like polycondensate. The polycondensation process will usually be conducted under aqueous conditions. Suitable catalysts are (water soluble) alkali salts such as sodium carbonate, as well as inorganic acids such as trifluoroacetic acid. To produce the polycondensate, the reaction mixture may be warmed. Usually, the polycondesation reaction will be carried out at a temperature above room temperature and preferably between 40 and 90° C.

The rate of the polycondensation reaction as well as the degree of crosslinking of the resultant gel can, for example, be influenced by the relative amounts of the alcohol and catalyst. The skilled person would know how to adjust the amounts of these components used to achieve the desired outcome.

The resultant polycondensate can be further processed without first being dried. In a possible alternative embodiment, it may be dried so that all or some of the water may be removed. It has, however, been shown to be advantageous to not completely remove the water.

In order to produce particles of a desired size, it has been shown to be advantageous to reduce the size of the polycondensate before further processing. The size reduction of the polycondensate may be carried out using conventional mechanical size reduction techniques or grinding. It is preferred that the size reduction step results in the formation of granules with the desired size distribution, whereby the formation of a powder portion is substantially avoided.

The polycondensate (which has optionally been reduced in particle size) then undergoes pyrolysis. The pyrolysis may also be described as carbonisation. During pyrolysis, the polycondensate is heated to a temperature of between 300 and 1500° C., preferably between 700 and 1000° C. The pyrolysis forms a porous, low density carbon xerogel.

One way of influencing the properties of the carbon xerogel, such as the pore volume, surface area and/or pore size distribution, is to treat the polycondensate before, during or after pyrolysis with steam, air, $CO_2$, oxygen or a mixture of gases, which may be diluted with nitrogen or another inert gas. It is particularly preferred to use a mixture of nitrogen and steam.

Advantageously, the dried gels of the invention are very hard and strong; accordingly, their attrition rate is low and their pore structure can be manipulated more easily without concern for degradation of the material. In addition, whereas conventional carbons are black, the dried gels of the invention may have a glassy and shiny appearance, e.g. a glassy black appearance.

The dried gels of the invention may have any suitable form, for instance particulate, fibrous, or a single monolithic entity. Preferably, however, they are particulate. Suitable particle sizes are 100-1500 μm, or 150-1400 μm.

The carbonisation stage preferably takes place in a gaseous atmosphere comprising nitrogen, water and/or carbon dioxide. In other words, the dried gels used in the present invention may be non-activated or, in some embodiments, activated, e.g. steam activated or activated with carbon dioxide. Activation is preferred in order to provide an improved pore structure.

The dried gels may be incorporated into a smoke filter or smoking article by conventional means. As used herein, the term "smoking article" includes smokable products such as cigarettes, cigars and cigarillos whether based on tobacco, tobacco derivatives, expanded tobacco, reconstituted tobacco or tobacco substitutes and also heat-not-burn products. The preferred smoking articles of the invention are cigarettes. The smoking article is preferably provided with a filter for the gaseous flow drawn by the smoker, and the dried gel is preferably incorporated into this filter, but may alternatively or in addition be included in another part of the smoking article, such as in or on the cigarette paper, or in the smokable filler material.

The smoke filter of the invention may be produced as a filter tip for incorporation into a smoking article, and may be of any suitable construction. For example, with reference to FIG. 1, the filter (2) for a cigarette (1) may contain the carbonaceous dried gel (3) distributed evenly throughout fibrous filter material, such as cellulose acetate. The filter may alternatively be in the form of a "dalmatian" filter with the dried gel particles being distributed throughout a tow section at one end of the filter, which will be the tobacco rod end when incorporated into a cigarette.

Figure 2:
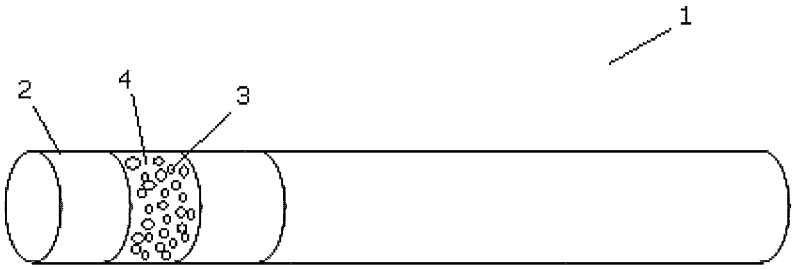
FIG. 2 shows carbonaceous dried gel particles located in the cavity of a cigarette filter.

Another option, with reference to FIG. 2, is to make the filter in the form of a "cavity" filter comprising multiple sections, the dried gel (3) being confined to one cavity (4). For instance, the cavity containing the dried gel may lie between two sections of fibrous filter material.

Figure 3:
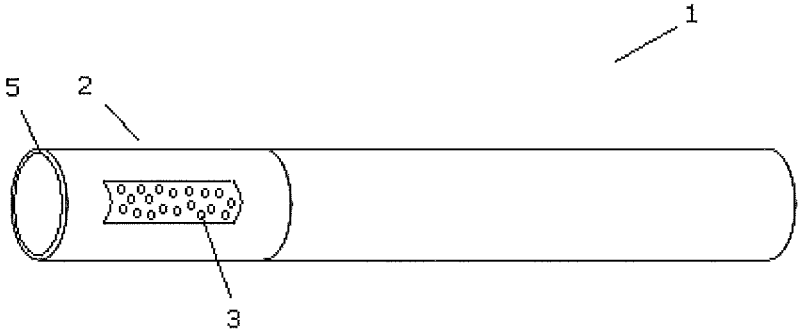
FIG. 3 shows a cigarette having a patch in the filter containing carbonaceous dried gel particles.

Alternatively, with reference to FIG. 3, the dried gel (3) may be located on the plug wrap (5) of the filter, preferably on the radially inner surface thereof. This may be achieved in a conventional manner (c.f. GB 2260477, GB 2261152 and WO 2007/104908), for instance by applying a patch of adhesive to the plug wrap and sprinkling the dried gel material over this adhesive.

A further option is to provide the dried gel in a form adhered to a thread (e.g. a cotton thread) passing longitudinally through the filter, in a known manner.

Other possibilities will be well known to the skilled person.

Any suitable amount of the dried gel may be used. Preferably, however, at least 10 mg, at least 15 mg, at least 25 mg or at least 30 mg of the dried gel is incorporated into the filter or smoking article.

When filtering tobacco smoke, it is advantageous to use a porous carbon material having a range of different pore sizes, so as to adsorb a range of different compounds in the smoke. The different sizes of pores found in the carbon materials are classified as follows, according to the IUPAC definition: micropores are less than 2 nm in diameter, mesopores are 2-50 nm in diameter, and macropores are greater than 50 nm in diameter. The relative volumes of micropores, mesopores and macropores can be estimated using well-known nitrogen adsorption and mercury porosimetry techniques; the former primarily for micro- and mesopores, and the latter primarily for meso- and macropores. However, since the theoretical bases for the estimations are different, the values obtained by the two methods cannot be compared directly with one another.

The present inventors have found that a particular group of carbonaceous dried gels exhibit additional advantages over coconut carbon in terms of the reductions in vapour phase smoke analytes. Specifically, carbon dried gels with a total pore volume (measured by nitrogen adsorption) of at least 0.5 $cm^3/g$, at least 0.1 $cm^3/g$ of which is in mesopores, show better performance than coconut carbon. A high BET surface area is not essential in this regard.

Preferably, the total pore volume (measured by nitrogen adsorption) is at least 0.5, 0.6, 0.7, 0.80, 0.85, 0.87, 0.89, 0.95, 0.98, 1.00, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0 or 3.1 $cm^3/g$.

Preferably, at least 0.1, 0.2, 0.3, 0.4, 0.5, 0.55, 0.60, 0.65, 0.70, 0.75, 0.80, 0.85, 0.9, 1.0, 1.1, 1.2, 1.3, 1.4, 1.5, 1.6, 1.7, 1.8, 1.9, 2.0, 2.1, 2.2, 2.3 or 2.4 $cm^3/g$ of the total pore volume is in mesopores (measured by nitrogen adsorption using BJH analysis on the desorption branch of the nitrogen isotherm).

Preferably, at least 0.05, 0.10, 0.15, 0.2, 0.3, 0.4, 0.5, 0.6 or 0.7 $cm^3/g$ of the total pore volume is in micropores (measured by nitrogen adsorption isotherm). In one embodiment, at least 0.4 $cm^3/g$ of the total pore volume is in micropores.

Preferably, the total volume of mesopores is greater than the total volume of micropores.

In an embodiment, the dried gels have a pore size distribution (measured by nitrogen adsorption) including a mode in the range of 15-45 nm, preferably in the range of 20-40 nm.

In one embodiment of the invention, the dried carbonaceous gels of the present invention have micropores and mesopores which are relatively large, that is, the mesopores have a pore size (diameter) of at least 10 nm and preferably of at least 20 nm (i e the mesopores have a pore size of 20-50 nm).

A ratio of at least 1:2 of micropores to mesopores is desirable, preferably a ratio of at least 1:3.

In an embodiment, the BET surface area is at least 500, 550, 600, 650, 700, 750, 800, 900, 1000, 1100, 1200, 1300, 1400, 1500, 1600, 1700, 1800 or 1900 $m^2/g$.

The invention will now be illustrated by way of the following examples.

Example 1—Xerogel Synthesis

Carbon xerogel samples were prepared by drying a resorcinol/formaldehyde polymer under ambient pressure conditions, according to the general process set out in *Chem. Mater*. (2004) 16, 5676-5681 (which incorrectly terms the resulting material an aerogel).

Resorcinol (Fluka®, puriss. (98.5% purity)), formaldehyde (Fluka®, 37% in water, methanol stabilized), and sodium carbonate (Fluka®, anhydrous, 99.5%) as the catalyst were dissolved in deionized water under stirring with a magnetic stir bar to obtain a homogeneous solution. After thermal curing for 1 day at room temperature, 1 day at 50° C. and 3 days at 90° C., the wet gels were introduced into acetone and left for 3 days at room temperature (fresh acetone being used daily) to exchange the water inside the pores. The samples were then dried at room temperature under ambient pressure, and pyrolyzed at temperatures of up to 800° C. (4°/min, 10 min at 800° C.) under an argon atmosphere, and thereby transformed into carbon xerogels.

The different samples were obtained by varying the catalyst concentration and reactant content, as shown in the table below. The resorcinol and formaldehyde was used in a molar ratio of 1:2 (which corresponds to the stoichiometry of the reaction).

| Sample | Percentage of resorcinol and formaldehyde used | Molar ratio of resorcinol:sodium carbonate |
|---|---|---|
| Xerogel 1 | 20 | 200:1 |
| Xerogel 4 | 50 | 1000:1 |
| Xerogel 6 | 40 | 500:1 |
| Xerogel 5 | 30 | 500:1 |
| Xerogel 2 | 50 | 500:1 |

All these xerogels took the form of glassy black granulates.

Example 2—Xerogel Properties

Nitrogen adsorption isotherms at 77K were obtained for the carbons of Example 1, and BJH analyses of the desorption branches conducted to calculate the pore sizes and size distributions. The surface areas of the samples were also measured. A microporous, steam activated coconut carbon (Ecosorb® CX from Jacobi Carbons) was tested as a control. The results are shown in the table below.

| Sample | Surface area ($m^2/g$)* | Total pore volume ($cm^3/g$)** | Pore volume in micropores ($cm^3/g$) | Pore volume in mesopores ($cm^3/g$) | Pore size range of the mesopores (nm) | Pore size with a maximum in the mesopore size range (nm) |
|---|---|---|---|---|---|---|
| Ecosorb ® CX | 1000 | 0.50 | 0.50 | 0 | — | — |
| Xerogel 1 | 650 | 0.38 | 0.17 | 0.21 | 3-5 | 4 |
| Xerogel 4 | 690 | 1.04 | 0.19 | 0.85 | 5-25 | 11 |
| Xerogel 6 | 680 | 0.89 | 0.19 | 0.70 | 4-22 | 10 |
| Xerogel 5 | 680 | 0.88 | 0.19 | 0.69 | 4-17 | 11 |
| Xerogel 2 | 710 | 0.84 | 0.16 | 0.68 | 5-14 | 10 |

*Surface areas were measured using the uptake at a relative pressure $P/P_0$ of 0.2

**Estimated from the amount of $N_2$ adsorbed at a relative pressure $P/P_0$ of 0.98

Example 3—Filter Performance

A cigarette of standard construction was provided (56 mm tobacco rod, 24.6 mm circumference, modified Virginia blend, 27 mm filter), the filter having a cavity bounded on both sides by a cellulose acetate section. 60 mg of Xerogel 1 obtained in Example 1 was weighed into the filter cavity. Further cigarettes were prepared in the same manner, each containing one of the other xerogel samples or the coconut carbon. A cigarette having an empty cavity of similar dimensions was used as a control. Once prepared, cigarettes were aged at 22° C. and 60% relative humidity for approximately three weeks prior to smoking.

The cigarettes were smoked under ISO conditions, i.e. a 35 ml puff of 2 seconds duration was taken every minute, and the tar, nicotine, water and carbon monoxide smoke yields were determined. The results are shown in the table below.

| Carbon in filter | Puff no. (per cig) | NFDPM (mg/cig) | Nicotine (mg/cig) | Water (mg/cig) | CO (mg/cig) |
|---|---|---|---|---|---|
| None | 6.9 | 11.1 | 0.93 | 2.1 | 10.6 |
| Ecosorb ® CX | 7.0 | 11.1 | 0.93 | 2.4 | 11.1 |
| Xerogel 1 | 7.2 | 11.2 | 0.96 | 2.8 | 10.9 |
| Xerogel 4 | 6.9 | 10.5 | 0.94 | 2.2 | 9.7 |
| Xerogel 6 | 7.1 | 10.4 | 0.90 | 2.7 | 10.4 |
| Xerogel 5 | 7.1 | 10.6 | 0.94 | 2.8 | 11.3 |
| Xerogel 2 | 7.2 | 11.5 | 0.97 | 2.7 | 11.2 |

These results show that the xerogels do not negatively affect the basic smoke yields; any differences are small and due to cigarette and analytical variability.

Percentage reductions in vapour phase smoke analytes, relative to the cigarette with no carbon in the filter, are shown below.

| | % Reductions in analyte smoke yields | | | | | |
|---|---|---|---|---|---|---|
| | Ecosorb ® CX | Xero-gel 1 | Xero-gel 4 | Xero-gel 6 | Xero-gel 5 | Xero-gel 2 |
| Acetaldehyde | 27 | 9 | 35 | 30 | 24 | 25 |
| Acetone | 32 | 12 | 53 | 45 | 40 | 40 |
| Acrolein | 35 | 16 | 59 | 52 | 45 | 42 |
| Butyraldehyde | 30 | 12 | 62 | 54 | 50 | 50 |
| Crotonaldehyde | 35 | 15 | 71 | 64 | 61 | 60 |
| Formaldehyde | 26 | 3 | 35 | 31 | 28 | 32 |
| MEK | 33 | 15 | 63 | 55 | 51 | 51 |
| Propionaldehyde | 31 | 12 | 53 | 47 | 42 | 41 |
| HCN | 15 | 12 | 33 | 21 | 22 | 21 |
| 1,3-butadiene | 25 | 13 | 48 | 45 | 42 | 36 |
| Aciylonitrile | 35 | 15 | 58 | 58 | 50 | 40 |
| Benzene | 31 | 16 | 61 | 60 | 54 | 42 |
| Isoprene | 35 | 16 | 64 | 61 | 54 | 46 |
| Toluene | 26 | 12 | 65 | 67 | 62 | 36 |
| Overall analyte | 29 | 12 | 48 | 43 | 38 | 35 |

The results show that all the xerogels tested were effective at filtering smoke. Xerogels 2, 4, 5 and 6 all showed improvements over the coconut carbon. However, Xerogel 1 was not as effective as the coconut carbon control, presumably due to its lower mesopore volume and/or smaller size of the mesopores.

Example 4—Synthesis of Further Xerogels

Five more carbon xerogel samples having micropores and mesopores (and, in the case of one sample, small macropores) were prepared as follows.

300.0 g resorcinol (Riedel-de Haen®, puriss. (98.5-100.5% purity)) was mixed with 1375 g deionised water, 442.25 g formaldehyde (Fluka®, 37% in water), and 0.415 g sodium carbonate (Fluka®, anhydrous), forming a clear solution. This solution was aged for 20 hours at room temperature, then 24 hours at 50° C. followed by 72 hours at 90° C. The polycondensate was crushed and introduced into 1500 ml acetone and left for 3 days at room temperature, replacing the solvent every day. The product was then dried at 50° C. for 3 days to produce a red-brown, brittle solid, which was ground in a rasp to form Granulate X having a particle size of 1-2 mm.

30.4 g Granulate X was filled into a quartz-tube and inserted into a rotary kiln. The solid was heated to 250° C. at a heating rate of 4 K/min under a nitrogen flow, and was kept at 250° C. for 1 hour. The solid was then heated to 800° C. at 4 K/min. The tube was not moved during the heating period, but the rotor was switched on after the solid reached 800° C., and the solid was maintained at this temperature for 30 minutes under nitrogen. It was then cooled to room temperature under a protective gas. The resulting non-activated carbon xerogel (186-02) was packed under air.

38.74 g Granulate X was filled into a quartz-tube and inserted into a rotary kiln. The solid was heated to 250° C. at a heating rate of 4 K/min under a nitrogen flow, and was kept at 250° C. for 1 hour. The solid was then heated to 800° C. at 4 K/min and maintained at this temperature for 30 min, then heated to 880° C. at 4 K/min. The tube was not moved during the heating period, but the rotor was switched on after the solid reached 880° C. The nitrogen flow was saturated with steam by bubbling through boiling water, the front end of the tube being heated to prevent condensation of the steam, and the solid was maintained at 880° C. for 60 min under the saturated nitrogen flow at 1.5 l/min. It was then cooled to room temperature under pure nitrogen. The resulting steam-activated carbon xerogel (186-04) was packed under air.

Xerogels 186-08 and 186-09 were produced in a similar manner to Xerogel 186-04, but starting with 48.35 g and 62.87 g Granulate X, respectively, and increasing the steam activation time to 150 minutes and 180 minutes, respectively.

Xerogel 008-10 was produced using the following simplified conditions. 120.75 g resorcinol (Riedel-de Haen®, puriss. (98.5-100.5% purity)) was mixed with 553 g deionised water, 178.0 g formaldehyde (Fluka®, 37% in water), and 0.167 g sodium carbonate (Fluka®, anhydrous), forming a clear solution. This solution was inserted into an oven in a closed PE-bottle and kept there for 2 hours at 50° C. followed by 14 hours at 90° C. After cooling to room temperature, the product was ground and dried at 50° C. for 4 hours. Further grinding of the red-brown solid in a rasp produced Granulate Y having a maximum particle size of 3 mm.

300 g Granulate Y was placed in a large quartz tube and inserted into a rotary kiln. The solid was heated to 880° C. at a heating rate of 4 K/min under a nitrogen flow, then the rotor was switched on. The nitrogen flow was saturated with steam by bubbling through boiling water, the front end of the tube being heated to prevent condensation of the steam, and the solid was maintained at 880° C. for 80 minutes under the saturated nitrogen flow. It was then cooled to room temperature under pure nitrogen. The resulting steam-activated carbon xerogel (Xerogel 008-10) was packed under air.

Xerogels 186-02, -04, -08, -09 and 008-10 all took the form of glassy black granulates.

Example 5—Xerogel Properties

Nitrogen adsorption isotherms at 77K were obtained, and BJH analyses of the desorption branches conducted. The properties of the carbons were as follows:

| Sample | Surface area ($m^2/g$)* | Total pore volume ($cm^3/g$)** | Pore volume in micropores ($cm^3/g$) | Pore volume in mesopores and any macropores ($cm^3/g$) | Pore size range of the mesopores and any macropores (nm) | Pore size with a maximum in the mesopore macropore size range (nm) |
|---|---|---|---|---|---|---|
| Ecosorb ® CX | 1000 | 0.50 | 0.50 | 0 | — | — |
| Xerogel 186-02 | 670 | 1.6 | 0.2 | 1.4 | 8-40 | 34 |
| Xerogel 186-04 | 1100 | 2.1 | 0.4 | 1.7 | 6-50 | 34 |
| Xerogel 008-10 | 1690 | 2.8 | 0.6 | 2.2 | 6-60 | 25 |
| Xerogel 186-08 | 1830 | 3.0 | 0.7 | 2.3 | 8-45 | 25 |
| Xerogel 186-09 | 1990 | 3.1 | 0.7 | 2.4 | 8-45 | 25 |

*Surface areas were measured using the uptake at a relative pressure $P/P_0$ of 0.2
**Estimated from the amount of $N_2$ adsorbed at a relative pressure $P/P_0$ of 0.98

The meso- and macropore structure of Xerogel 008-10 was also examined by mercury porosimetry. The volume of pores in the range of 6-100 nm was 2.2 $cm^3/g$, in excellent agreement with the nitrogen adsorption results. In other words, no large macropores are present (which would not be detected by nitrogen adsorption).

Figure 4:
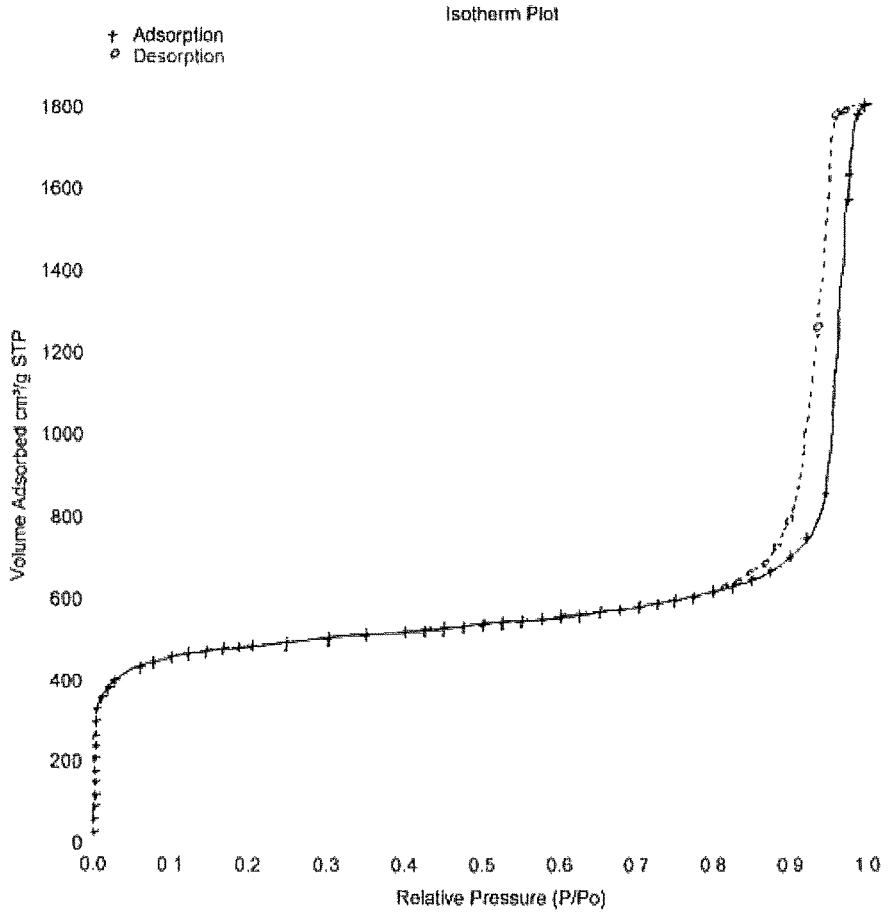
FIG. 4 shows a nitrogen adsorption isotherm for a carbonaceous dried gel of the invention.

As an example, the isotherm plot for Xerogel 008-10 is shown in FIG. 4.

Example 6—Filter Performance

Cigarettes were prepared and smoked in accordance with the method of Example 3, but instead using the Xerogels 186-02, -04, -08 and -09 of Example 4 and coconut carbon control of Example 2. The results are shown in the table below.

| | % Reductions in analyte smoke yields (compared with empty cavity) | | | | |
|---|---|---|---|---|---|
| Carbonaceous additive | Ecosorb ® CX | Xerogel 186-02 | Xerogel 186-04 | Xerogel 186-08 | Xerogel 186-09 |
| Acetaldehyde | 23 | 38 | 46 | 61 | 56 |
| Acetone | 31 | 60 | 75 | 91 | 93 |
| Acrolein | 37 | 71 | 78 | 91 | 92 |
| Butyraldehyde | 36 | 69 | 84 | 95 | 96 |
| Crotonaldehyde | 37 | 78 | 87 | 92 | 94 |
| Formaldehyde | 27 | 43 | 53 | 57 | 60 |
| Methyl Ethyl Ketone | 34 | 71 | 84 | 96 | 97 |
| Propionaldehyde | 34 | 64 | 78 | 93 | 94 |
| HCN | 38 | 50 | 62 | 63 | 61 |
| 1,3-butadiene | 14 | 59 | 66 | 91 | 91 |
| Acrylonitrile | 25 | 68 | 72 | 88 | 88 |
| Benzene | 23 | 71 | 79 | 88 | 88 |
| Isoprene | 28 | 80 | 79 | 91 | 90 |
| Toluene | 17 | 53 | 53 | 54 | 52 |
| Average analyte | 29 | 63 | 71 | 82 | 82 |

# = limit of quantitation value

As will be evident from this data, these xerogels show outstanding performance in smoke filtration compared with coconut carbon and with the xerogels of Example 1. Within this series, increasing total pore volume, micropore volume, mesopore volume and surface area correlates with improving smoke filtration properties.

Example 7—Filter Performance Under Different Smoking Regimes

Cigarettes were prepared in the same manner as in Example 3, containing either 60 mg Xerogel 008-10 or 60 mg Ecosorb® CX. The cigarettes were then smoked under two different smoking regimes. The first was a standard smoking regime, involving a 35 ml puff of 2 seconds duration was taken every 60 seconds (35/2/60). The second was an intensive smoking regime, i.e. a 55 ml puff of 2 seconds duration was taken every 30 seconds (55/2/30). The xerogel of the invention showed better performance than the coconut carbon, as seen in the table below.

| | % Reductions in analyte smoke yields (compared with empty cavity) | | | |
|---|---|---|---|---|
| Carbonaceous filter additive | Ecosorb ® CX | Xerogel 008-10 | Ecosorb ® CX | Xerogel 008-10 |
| Smoke regime | 35/2/60 | 35/2/60 | 55/2/30 | 55/2/30 |
| Acetaldehyde | 34 | 66 | 16 | 29 |
| Acetone | 44 | 92 | 28 | 60 |
| Acrolein | 48 | 93 | 35 | 63 |
| Butyraldehyde | 47 | 94 | 34 | 80 |
| Crotonaldehyde | 56 | 95# | 46 | 93 |
| Formaldehyde | 36 | 60 | 42 | 68 |
| Methyl Ethyl Ketone | 49 | 96 | 36 | 84 |
| Propionaldehyde | 42 | 88 | 29 | 56 |
| HCN | 44 | 84 | 25 | 54 |
| 1,3-butadiene | 20 | 83 | 22 | 51 |
| Acrylonitrile | 44 | 82 | 31 | 77 |
| Benzene | 43 | 85 | 29 | 84 |
| Isoprene | 41 | 89# | 23 | 87 |
| Toluene | 35 | 60# | 26 | 66# |

#= limit of quantitation value

Example 8—Varying the Xerogel Properties 60.0 g resorcinol (puriss. (98.5-100.5% purity (Riedel-de Haen®, Catalogue no. RdH 16101-1KG))=545 mmol, was mixed in a polyethylene bottle (500 ml) with 275 g deionised water, 88.45 g formaldehyde solution (Fluka®, 37%)=1090 mmol and 83 mg anhydrous sodium carbonate (Fluka®)=0.78 mmol to obtain a clear solution.

The bottle was sealed and placed in a 600 ml beaker, then placed in a convection oven at 90° C. for 16 hours. Subsequently, the bottle was removed from the oven. Once it had cooled to room temperature, the red-brown polycondensate was removed from the bottle. The soft product was broken into coarse pieces using a spatula and placed into a flat aluminium pan (16 cm diameter) and dried in a convection oven with a high air flow rate at 50° C. for 4 hours.

The result was 267.9 g of a moist yet already brittle material. The cooled material was ground to a red-brown granulate (maximum particle size 3 mm) in a drum mill to form Granulate Z.

Example 8a 12.4 g of Granulate Z was filled into a quartz-tube and inserted into a rotary kiln. The tube was not moved during the heating phase.

The tube was flushed with nitrogen and under a constant nitrogen flow was heated at a rate of 4 K/min from room temperature to 250° C. and was kept at this temperature for 1 hour. Then it was heated at a rate of 4 K/min to 800° C. and, at reaching this temperature, the rotor of the kiln was switched on. The quartz tube was turned for 30 minutes at 800° C. under a nitrogen flow. Then, it was cooled to room temperature under a protective gas. The resultant carbon xerogel was packed under air. Product: 1.88 g (1 kg resorcinol produces 677 g carbon xerogel).

$N_2$ Physisorption Analysis:

BET surface area: 659 $m^2/g$

Single Point Total Pore Volume: 1.19 $cm^3/g$

Ratio of micropore volume:mesopore volume (measured by nitrogen physisorption): 1:4.89

Mesopore diameter (measured by BJH desorption): maximum at 32 nm

Example 8b 47.24 g of Granulate Z was filled into a quartz-tube and inserted into a rotary kiln. The tube was not moved during the heating phase.

The tube was flushed with nitrogen and under a constant nitrogen flow was heated at a rate of 4 K/min from room temperature to 880° C. At reaching this temperature, the rotor of the kiln was switched on. The protective nitrogen gas was then bubbled through simmering water before reaching the rotary kiln. The region of gas entry into the quartz tube was heated to prevent the water from condensing there. The quartz tube was turned for 15 minutes at 880° C. under the saturated nitrogen flow (1.5 l/min) Then, the material was cooled to room temperature under dry nitrogen. The resultant carbon xerogel was packed under air. The process took 1.5 days from the mixing of the polymer solution to obtaining the carbon xerogel. Product: 5.73 g (1 kg resorcinol produces 542 g carbon xerogel).

$N_2$ Physisorption Analysis:

BET surface area: 992 $m^2/g$

Single Point Total Pore Volume: 1.65 $cm^3/g$

Ratio of micropore volume:mesopore volume (measured by nitrogen physisorption): 1:3.80

Mesopore diameter (measured by BJH desorption): maximum at 33 nm

Example 8c 51.1 g of Granulate Z was processed as in Example 1b, except that the material was activated for 30 minutes at 880° C. under saturated nitrogen (rather than 15 minutes). Product: 5.38 g (1 kg resorcinol produces 470 g carbon xerogel).

$N_2$ Physisorption Analysis:

BET surface area: 1254 $m^2/g$

Single Point Total Pore Volume: 1.93 $cm^3/g$

Ratio of micropore volume:mesopore volume (measured by nitrogen physisorption): 1:3.55

Mesopore diameter (measured by BJH desorption): maximum at 33 nm

Example 8d 51.04 g of Granulate Z was processed as in Example 8b, except that the material was activated for 60 minutes at 880° C. under saturated nitrogen (rather than 15 minutes). Product: 3.62 g (1 kg resorcinol produces 317 g carbon xerogel).

$N_2$ Physisorption Analysis:

BET surface area: 1720 $m^2/g$

Single Point Total Pore Volume: 2.53 $cm^3/g$

Ratio of micropore volume:mesopore volume (measured by nitrogen physisorption): 1:3.49

Mesopore diameter (measured by BJH desorption): maximum at 24 nm

Example 8e

Granulate Z was processed as in Example 8b, except that the material was activated for 105 minutes at 880° C. under saturated nitrogen (rather than 15 minutes). Product: 2.11 g (1 kg resorcinol produces 180 g carbon xerogel).

$N_2$ Physisorption Analysis:

BET surface area: 2254 $m^2/g$

Single Point Total Pore Volume: 3.23 $cm^3/g$

Ratio of micropore volume:mesopore volume (measured by nitrogen physisorption): 1:4.19

Mesopore diameter (measured by BJH desorption): maximum at 25 nm

Example 9—Varying the Xerogel Properties 25.85 g resorcinol (98% purity)=230 mmol was mixed in a polyethylene bottle (250 ml) with 118.5 g deionised water, 37.40 g formaldehyde solution (Fluka®, 37%)=461 mmol and 36 mg anhydrous sodium carbonate (Fluka®)=0.34 mmol to obtain a clear solution.

The bottle was sealed and placed in a beaker, then placed in a convection oven at 90° C. for 16 hours. Subsequently, the bottle was removed from the oven. Once it had cooled to room temperature, the red-brown polycondensate was removed from the bottle. The soft product was broken into coarse pieces using a spatula and placed into a flat aluminium pan (16 cm diameter) and dried in a convection oven with a high air flow rate at 50° C. for 4 hours.

The resultant material weighed 99.4 g. The cooled material was ground to a red-brown granulate (maximum particle size 3 mm) in a drum mill.

39.05 g of the granulate was filled into a quartz-tube and inserted into a rotary kiln. The tube was not moved during the heating phase.

The tube was flushed with nitrogen and under a constant nitrogen flow was heated at a rate of 4 K/min from room temperature to 880° C. At reaching this temperature, the rotor of the kiln was switched on. The protective nitrogen gas was then bubbled through simmering water before reaching the rotary kiln. The region of gas entry into the quartz tube was heated to prevent the water from condensing there. The quartz tube was turned for 60 minutes at 880° C. under a saturated nitrogen flow (1.5 l/min) Then, the material was cooled to room temperature under dry nitrogen. The resultant carbon xerogel was packed under air. The resultant product was 3.12 g of a black granulate.

$N_2$ Physisorption Analysis:

BET surface area: 1843 $m^2/g$

Single Point Total Pore Volume: 2.72 $cm^3/g$

Ratio of micropore volume:mesopore volume (measured by nitrogen physisorption): 1:3.64

Mesopore diameter (measured by BJH desorption): maximum at 24 nm

Example 10—Varying the Xerogel Properties 35.0 g resorcinol (puriss. (Riedel-de Haen®, Catalogue no. RdH 16101))=318 mmol was mixed in a polyethylene bottle (250 ml) with 24.5 g deionised water, 51.65 g formaldehyde solution (Fluka®, 37%)=636 mmol and 66.5 mg anhydrous sodium carbonate (Fluka®)=0.63 mmol to obtain a clear solution.

The bottle was sealed and placed in a beaker, then placed in a convection oven at 90° C. for 16 hours. Subsequently, the bottle was removed from the oven. Once it had cooled to room temperature, the red-brown polycondensate was removed from the bottle. The hard, glassy block was broken up into coarse pieces using a hammer, placed into a flat aluminium pan (16 cm diameter) and dried in a convection oven with a high air flow rate at 50° C. for 4 hours.

The result was 59.23 g of product. The cooled material was ground to a red-brown granulate (maximum particle size 3 mm) in a drum mill 18.54 g of the granulate was filled into a quartz-tube and inserted into a rotary kiln. The tube was not moved during the heating phase.

The tube was flushed with nitrogen and under a constant nitrogen flow was heated at a rate of 4 K/min from room temperature to 880° C. At reaching this temperature, the rotor of the kiln was switched on. The protective nitrogen gas was then bubbled through simmering water before reaching the rotary kiln. The region of gas entry into the quartz tube was heated to prevent the water from condensing there. The quartz tube was turned for 60 minutes at 880° C. under a saturated nitrogen flow (1.5 l/min). Then, the material was cooled to room temperature under dry nitrogen. The resultant carbon xerogel was packed under air. The resultant product was 3.62 g of a black granulate (1 kg resorcinol produces 330 g carbon xerogel).

$N_2$ Physisorption Analysis:

BET surface area: 1628 $m^2/g$

Single Point Total Pore Volume: 1.56 $cm^3/g$

Ratio of micropore volume:mesopore volume (measured by nitrogen physisorption): 1:1.83

Mesopore diameter (measured by BJH desorption): maximum at 8 nm.

The invention claimed is:

1. A smoking article comprising smokeable material and a carbonaceous dried gel, wherein the carbonaceous dried gel is at least one of a xerogel, aerogel, or cryogel, wherein the carbonaceous dried gel has a total pore volume, measured by nitrogen adsorption, of at least 2.1 $cm^3/g$, and has mesopores and micropores with the ratio of mesopores to micropores being at least 2:1, as measured by nitrogen adsorption using BJH analysis on the desorption branch of the nitrogen isotherm.

2. The smoking article as claimed in claim 1, wherein the carbonaceous dried gel is a xerogel.

3. The smoking article as claimed in claim 1, wherein at least 0.05 $cm^3/g$ of the total pore volume of the carbonaceous dried gel is in micropores as measured by nitrogen adsorption isotherm.

4. The smoking article as claimed in claim 1, wherein the carbonaceous dried gel has a pore size distribution having a mode in the range of 15-45 nm.

5. The smoking article as claimed in claim 1, wherein the carbonaceous dried gel has a BET surface area of the carbonaceous dried gel of at least 500 $m^2/g$.

6. The smoking article as claimed in claim 1, wherein the carbonaceous dried gel is obtainable by aqueous polycondensation of an aromatic alcohol with formaldehyde followed by drying and carbonization.

7. The smoking article as claimed in claim 1, wherein the carbonaceous dried gel is activated by steam and/or carbon dioxide.

8. The smoking article as claimed in claim 1, the smoking article further comprising a filter and the filter comprising the carbanaceous dried gel.

9. A filter for a smoking article, the filter comprising a carbonaceous dried gel wherein the carbonaceous dried gel is at least one of a xerogel, aerogel, or cryogel, and wherein the carbonaceous dried gel has a total pore volume, measured by nitrogen adsorption, of at least 2.1 $cm^3/g$, a pore volume in mesopores and any macropores measured by nitrogen adsorption of at least 1.7 $cm^3/g$, and has mesopores and micropores with the ratio of mesopores to micropores being at least 2:1, as measured by nitrogen adsorption using BJH analysis on the desorption branch of the nitrogen isotherm.

10. The smoking article as claimed in claim 1, wherein the carbonaceous dried gel has a pore size distribution having a mode in the mage of 20-40 nm.

11. The smoking article as claimed in claim 1, wherein the carbonaceous dried gel is: (1) adhered to a plug wrap surrounding the filter, and/or (2) adhered to a thread disposed longitudinally within the filter.

12. The smoking article as claimed in claim 1, wherein the carbonaceous dried gel has mesopores with a pore size of from 10 nm to 50 nm.

13. The filter for a smoking article as claimed in claim 9, wherein the carbonaceous dried gel has mesopores with a pore size of from 10 nm to 50 nm.

* * * * *